US007600822B2

(12) United States Patent
Klabisch et al.

(10) Patent No.: US 7,600,822 B2
(45) Date of Patent: Oct. 13, 2009

(54) METHOD FOR THE MINING OF COAL AND COAL PLANER INSTALLATION

(75) Inventors: Adam Klabisch, Dortmund (DE); Gerhard Merten, Lünen (DE)

(73) Assignee: DBT GmbH (DE)

( * ) Notice: Subject to any disclaimer, the term of this patent is extended or adjusted under 35 U.S.C. 154(b) by 475 days.

(21) Appl. No.: 11/494,827

(22) Filed: Jul. 28, 2006

(65) Prior Publication Data

US 2007/0029864 A1 Feb. 8, 2007

(30) Foreign Application Priority Data

Jul. 29, 2005 (DE) ..... 10 2005 036 359

(51) Int. Cl.
*E21C 27/36* (2006.01)

(52) U.S. Cl. ..... 299/1.6; 299/34.07

(58) Field of Classification Search ..... 299/1.6, 299/34.01, 34.07
See application file for complete search history.

(56) References Cited

U.S. PATENT DOCUMENTS

| | | | | |
|---|---|---|---|---|
| 3,809,431 | A * | 5/1974 | Nakajima | 299/34.07 |
| 4,037,876 | A * | 7/1977 | Georg et al. | 299/43 |
| 4,260,191 | A * | 4/1981 | Weber | 299/1.6 |
| 5,647,640 | A * | 7/1997 | Heintzmann et al. | 299/1.6 |
| 5,931,540 | A * | 8/1999 | Merten et al. | 299/1.6 |

FOREIGN PATENT DOCUMENTS

| | | |
|---|---|---|
| DE | 42 37 896 C1 | 11/1992 |
| DE | 196 16 931 C2 | 4/1996 |

* cited by examiner

*Primary Examiner*—John Kreck
(74) *Attorney, Agent, or Firm*—Baker & McKenzie LLP

(57) ABSTRACT

A method for mining and a planer installation for the mining of coal, with a coal planer that can be moved by a planer chain that can be driven via a drive chain wheel of a drive station for the planer chain and that is deflected at a deflection chain wheel of a driveless deflection station. The coal planer is moved back and forth reversibly between the drive station and the deflection station by the planer chain to avoid the occurrence of sag and to minimize the necessary size of an auxiliary drift to be opened. The deflection chain wheel is mounted on a slide that can be displaced in the direction of movement of the coal planer by a tension device.

12 Claims, 4 Drawing Sheets

METHOD FOR THE MINING OF COAL AND COAL PLANER INSTALLATION

CROSS-REFERENCE TO RELATED APPLICATION

This application claims priority to German Patent Application No. 10 2005 036 359.8 filed on Jul. 29, 2005.

The invention relates to a method for the mining of coal by means of a coal planer installation having a coal planer which is moved by means of a planer chain which is driven via a drive chain wheel of a drive station for the planer chain and is deflected at the deflection chain wheel of a driveless deflection station. The invention, furthermore, relates to a coal planer installation for the mining of coal, with a coal planer which can be moved by means of a planer chain which can be driven via a drive chain wheel of a drive station for the planer chain and is deflected at the deflection chain wheel of a driveless deflection station.

In modern coal planer installations, it is customary to move the coal planer back and forth by means of the planer chain reversibly between two drive stations having drive and deflection chain wheels for the planer chain. The bus technique in underground mining allows communication between the drives (motors and transmissions) of the two drive stations for the planer chain, in order as far as possible to avoid the occurrence of sag in the planer chain by means of a suitable activation of the drives. The greatest risk of the occurrence of sag is in this case in the event of blockages of the coal planer, at the commencement of the planer travel and during a reversal in the direction of movement of the planer. Where reversibly operating planer installations are concerned, the axes of rotation of the driven planer chain wheels lie perpendicularly to the direction of movement, and the strands of the planer chain belt run, in the tension strand and in the return strand, along the entire longwall face one above the other in a vertical plane with a height offset in relation to one another.

An alternative concept for planer installations uses continuously rotating planer bodies. In this case, by means of the planer chain, at least two and often a larger number of planer bodies are moved continuously in rotation (for example, DE 196 16 931 C2 or DE 42 37 896 C1). Where continuously operating coal planer installations are concerned, the planer chain tension strand arranged on the coalface side and the planer chain return strand running on the packing side lie with a height offset and lateral offset in relation to one another. During the return, the planer bodies may be supported on the top side of the chain scraper laid parallel to the planer installation or may be guided in another way on the chain scraper conveyor. On account of these different positions of the planer bodies at the work face and during the return movement of the planer bodies, it is customary, in the case of continuously operating mining devices, to set the axis of rotation or drive axis of the two planer chain wheels obliquely, in order to achieve a uniform transition, for example, from planer bodies guided vertically along the coalface to planer bodies returned horizontally above the chain scraper conveyor. Where continuously operating coal planer installations are concerned, the occurrence of sag plays only a minor role. However, so that the chain can be tensioned during continuous operation, the two drive and deflection stations of continuously operating coal planer installations are mostly designed as tensioning stations.

Particularly where reversibly operating planer installations are concerned, the occurrence of sag may, furthermore, lead to serious problems and/or a chain break. Moreover, reversibly operating planer installations have the disadvantage that the limit stop for a reversal in movement of the planer body must be at a relatively great distance from the planer chain wheel, and the drive stations have a relatively large build.

The object of the invention is to provide a coal planer installation, in which the above-mentioned problems, particularly the formation of sag and a poor loading behavior in the region of the drive and reversal stations, do not arise.

In terms of the method, the above-mentioned object is achieved, according to the invention, in that the coal planer is moved back and forth reversibly by means of the planer chain between the drive station and the preferably driveless reversal station, while, to avoid sag in the planer chain, the deflection chain wheel is displaced in the direction of movement of the coal planer, as a function of the position of the coal planer, during the continuous operation of the planer installation. In the method according to the invention with a coal planer installation which preferably has only a single drive station, the entire electrical power for moving the coal planer being applied by means of the drive of this drive station, the position of the nondriven deflection chain wheel is varied in order to avoid the formation of sag. By the position of the deflection chain wheel and consequently the chain elongation of the planer chain being varied, the occurrence of sag can be actively counteracted. Admittedly, in the case of an only one-sided drive of a reversibly operating coal planer, only a low planer chain force can be transmitted to the coal planer in the direction of travel of the coal planer away from the drive toward the driveless deflection station, since, in this direction of travel, all the losses due to the chain weight and chain friction of tension strand and return strand take effect; however, the advantage of a reversibly operating coal planer installation with only a single drive station is that the entire electrical power has to be provided at only one location of the longwall face, specifically at the longwall face/main heading transition, and there is no need for balancing between a main drive and an auxiliary drive. A further advantage is that the auxiliary drift can have a substantially smaller build than was required in the case of the previous reversibly operating coal planer installations, since the drive for the coal planer can be arranged solely in the main heading.

According to a preferred refinement of the method according to the invention, the coal planer executes a reversing cycle which consists of a movement travel of the coal planer from the drive station to the reversal station and back, according to the invention, in a reversible cycle, the deflection chain wheel being displaced into a position with maximum chain pretension or chain elongation before or at the commencement of the reversing cycle and being displaced into a position with minimum chain tension or chain elongation continuously, or according to a movement algorithm, during the reversing cycle.

So that the deflection chain wheel can be displaced in a simple way, it is particularly advantageous if the deflection chain wheel is mounted on a slide which is guided displaceably in a slide guide. In the particularly preferred refinement, the axis of rotation of the deflection chain wheel does not run horizontally or parallel to the floor, as is necessary in the prior art in the case of reversibly operating planer installations on account of the transmission of force from the drives to the driven chain wheels, but, instead, the axis of rotation in the deflection chain wheel runs obliquely and in this case preferably so as to be inclined at a suitable angle of between about 30° and 60° to the horizontal. Since there is no drive of the deflection chain wheel in the conduct of the method according to the invention, the deflection chain wheel may be mounted in a suitable way on the slide with an axis standing obliquely or running obliquely. In the reversibly operating planning method, the oblique mounting of the deflection chain wheel has the particular advantage that the reversal station of the coal planer installation can have a smaller overall height than in drive stations with a horizontal position of the axis of rotation of the drive chain wheel. A further advantage in the case of an obliquely set deflection chain wheel is that, when the deflection chain wheels have large diameters, the planer chain experiences relatively minor vertical angling in the region of the reversal station itself, so that a better transition of the strands of the planer chain into the chain guide channels can be achieved in the region of the longwall face. Moreover, if, at the time at which the planer body reaches the deflection chain wheel during the reversing cycle, the deflection chain wheel is in a position displaced into the auxiliary drift, as compared with the initial position, the planer body can be moved markedly more closely to the stationary machine frame of, for example, a connected chain scraper conveyor than has been customary in the prior art, so that the mining behavior in the end region of the longwall face, particularly at the transition to the auxiliary drift, is also improved.

The above-mentioned object is achieved, according to the invention, in a coal planer installation, in that the coal planer operates reversibly, and in that the deflection chain wheel is mounted in a slide which can be displaced in the direction of movement of the coal planer by means of a tension device. A mounting of the deflection chain wheel on or in a moveable slide makes it possible in a comparatively simple way to retension a sag by a change in the position of the deflection chain wheel. In the coal planer installation according to the invention, too, so that approximately the same planning work can be performed by the coal planer, the power installed on the preferably single drive must be markedly higher than in generic reversibly operating planer installations with two drives. In modern coal planer installations, drives with a power of about 400 kW are used at both drive stations. In a coal planer installation according to the invention with a driveless reversal station, the drive of the single drive station can be equipped with a power of, for example, 800 kW or 1 000 kW, in the latter embodiment higher planer chain forces being achieved, in the direction of movement of the coal planer both away from the drive station and toward the drive, than in the case of an installed power of 2 times 400 kW. The form of the method and/or the coal planer installation with a driveless deflection station in this case constitutes the preferred form. However, an alternative concept could be provided, whereby a drive with a low drive power of, for example, 100 kW is arranged and installed at the deflection station.

In the coal planer installation according to the invention, too, particularly in an embodiment with a driveless deflection station, it is especially advantageous if the axis of rotation of the deflection chain wheel runs obliquely, in order, once again, to reduce the necessary overall height in the deflection station and to achieve a better loading behavior in the region of the deflection station. The axis of rotation of the deflection chain wheel is preferably oriented with an inclination at a suitable angle of between 30° and 60°, in particular, for example, about 45°, with respect to the horizontal in the mining direction or advancing direction.

As is known per se, the coal planer installation is preferably provided with a conveying device which is provided with planer guide elements for guiding the coal planer and which has a conveyor chain belt driven continuously in rotation by means of two drive stations. Where corresponding coal planer installations are concerned, it is especially advantageous if the slide is guided in a slide guide which is an integral part of a planer guide built on a machine frame of one of the drive stations. Also preferably, in this refinement, a single or at least one tension cylinder for displacing the slide may be arranged between the planer guide having the slide guide and the side cheek of the associated drive station of the chain scraper conveyor. In order to provide sufficient construction space for arranging the tension cylinder or tension cylinders, the distance of the planer guide from the drive station in the entry region of the deflection chain wheel may advantageously increase toward the latter. In a preferred refinement, the tension cylinder is articulated, at one end, on the side cheek of the drive station or of the machine frame having the drive chain wheel for the chain scraper conveyor and, at the other end, on the slide. Furthermore, in the coal planer installation, it is especially advantageous if the tension strand and the return strand of the planer chain run next to one another, with a height offset, in the region of the deflection chain wheel and run one above the other, with a height offset, on the longwall face and at the driven planer chain wheel (drive chain wheel).

Further advantages and refinements of the invention may be gathered from the following description of an exemplary embodiment shown diagrammatically in the drawing in which.

Figure 1:
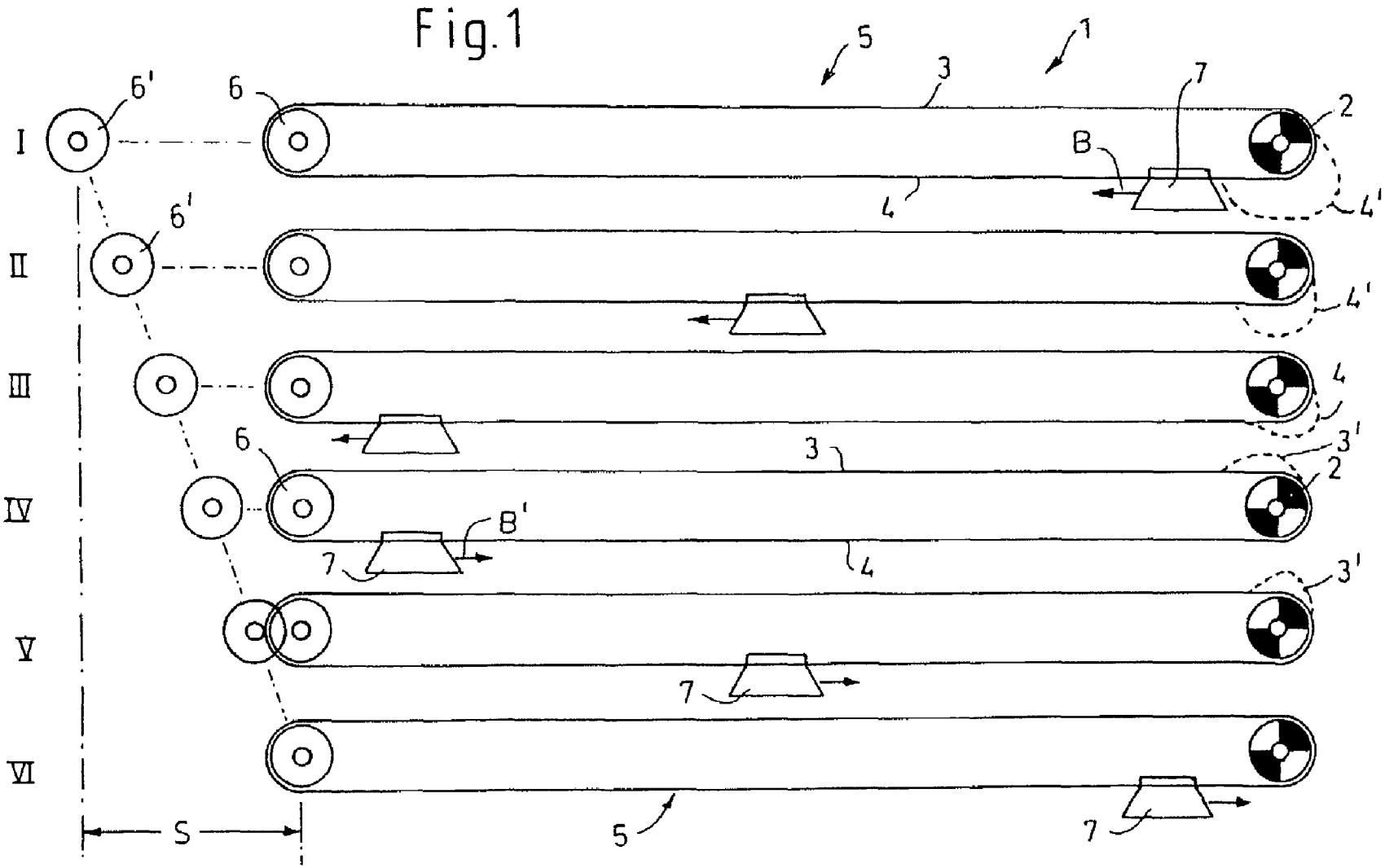
FIG. 1 shows a diagram of the different positions of the deflection chain wheel during the operation of a coal planer installation according to the invention.

FIG. 1 illustrates, considerably simplified and in diagrammatic form, a coal planer installation, designated as a whole by the reference symbol 1, in six different operating states during a reversing cycle. In the coal planer installation 1 in FIG. 1, reference symbol 2 designates a drive chain wheel 2 driven by means of a drive, not illustrated, of a drive station, for a planer chain 5 having an upper return strand 3 and a lower tension strand 4, and reference symbol 6 designates a deflection chain wheel of a driveless reversal station, not illustrated. In the coal planer installation 1, only the drive chain wheel 2 is driven by means of a drive. Via the planer chain 5 driven by means of the drive chain wheel 2 and deflected at the deflection chain wheel 6, a reversibly operating coal planer 7 is driven in each case in the direction of movement B and B'. In subimages I, II and III in FIG. 1, the coal planer 7 travels in the direction of movement B from the driven drive chain wheel 2 to the nondriven reversal chain wheel 6. Subimages IV, V and VI in FIG. 1 show the reversed direction of movement B' of the coal planer 7 from the nondriven deflection chain wheel 6 to the driven drive chain wheel 2. Since the coal planer installation 1 according to the invention has only one drive station with the drive chain wheel 2, the planer chain tensile force transmitted to the coal planer 7 by means of the drive chain wheel 2 is greater in the direction of movement B' than in the direction of movement B, since, in the direction of movement B, all the frictional forces of the tension strand 4 and of the return strand 3, which arise in the respective chain guide channels of planer guides for the coal planer 7, take effect in the tension direction, whereas, in the direction of movement B', primarily only the frictional forces of that length of the tension strand 4 which remains between the drive chain wheel 2 and the coal planer 7 take effect.

In the coal planer installation 1 according to the invention, as will also be explained, the deflection chain wheel 6 is mounted displaceably in the direction of movement B and B' on a slide, the displacement movement being applied by means of a tension cylinder which displaces the slide in relation to the reversal station or drive station. The maximum tension travel or displacement travel of the deflection chain wheel 6 is designated in FIG. 1 by reference symbol S, and the different positions of the deflection chain wheel 6 are illustrated in each case in subimages I to V. The deflection chain wheel displaced out of the basic position is designated by reference symbol 6'. At the same time, FIG. 1 indicates, in each case in the region of the driven drive chain wheel 2, the occurrence of sag 4' in the tension strand 4 (subimages I, II and III) and 3' in the return strand 3 (subimages IV and V), which sag 3', 4' could occur if the deflection chain wheel 6 were not displaced into the respective position according to 6'. A primary risk of the occurrence of sag is, on the one hand, in the event of blockages of the coal planer 7 during movement travel in the direction of movement B or B' and, in particularly, at the commencement of a reversing cycle when the coal planer 7 travels from the drive chain wheel 2 toward the deflection chain wheel 6, and also at the commencement of the return movement in the direction of movement B' when the coal planer 7 comes up against the deflection chain wheel 6. In order to avoid an occurrence of sag at the commencement of a reversing cycle, the deflection chain wheel is displaced into the maximum push-out position according to the tension length S of the tension cylinder, so that, on the one hand, a maximum chain tension in the planer chain 5 is achieved and, at the same time, the elongation of the planer chain 5 prevents the situation where sag may occur in the planer chain portion of the tension strand 4 between the drive chain wheel 2 and the coal planer 7 traveling in the direction of movement B. As shown in FIG. 1, the displacement of the deflection chain wheel 6' may gradually be reduced until a reversing cycle is terminated, so that, at the end of the reversing cycle, said end corresponding to subimage VI, the chain tension in the planer chain 5 is minimum and the tension cylinder assumes its minimum push-out position. It is noted, as a precaution, that, here, minimum and maximum do not necessarily relate to the possible push-out length of the tension cylinder, but, instead, to the relative push-out length with respect to the reversing cycle and to the elongation of the planer chain 5. Before the coal planer 7 starts a reversing cycle according to subimage I once more, the deflection chain wheel 6 must first be displaced again into the position shown in subimage I, in order to achieve maximum chain tension in the planer chain 5.

Figure 2:
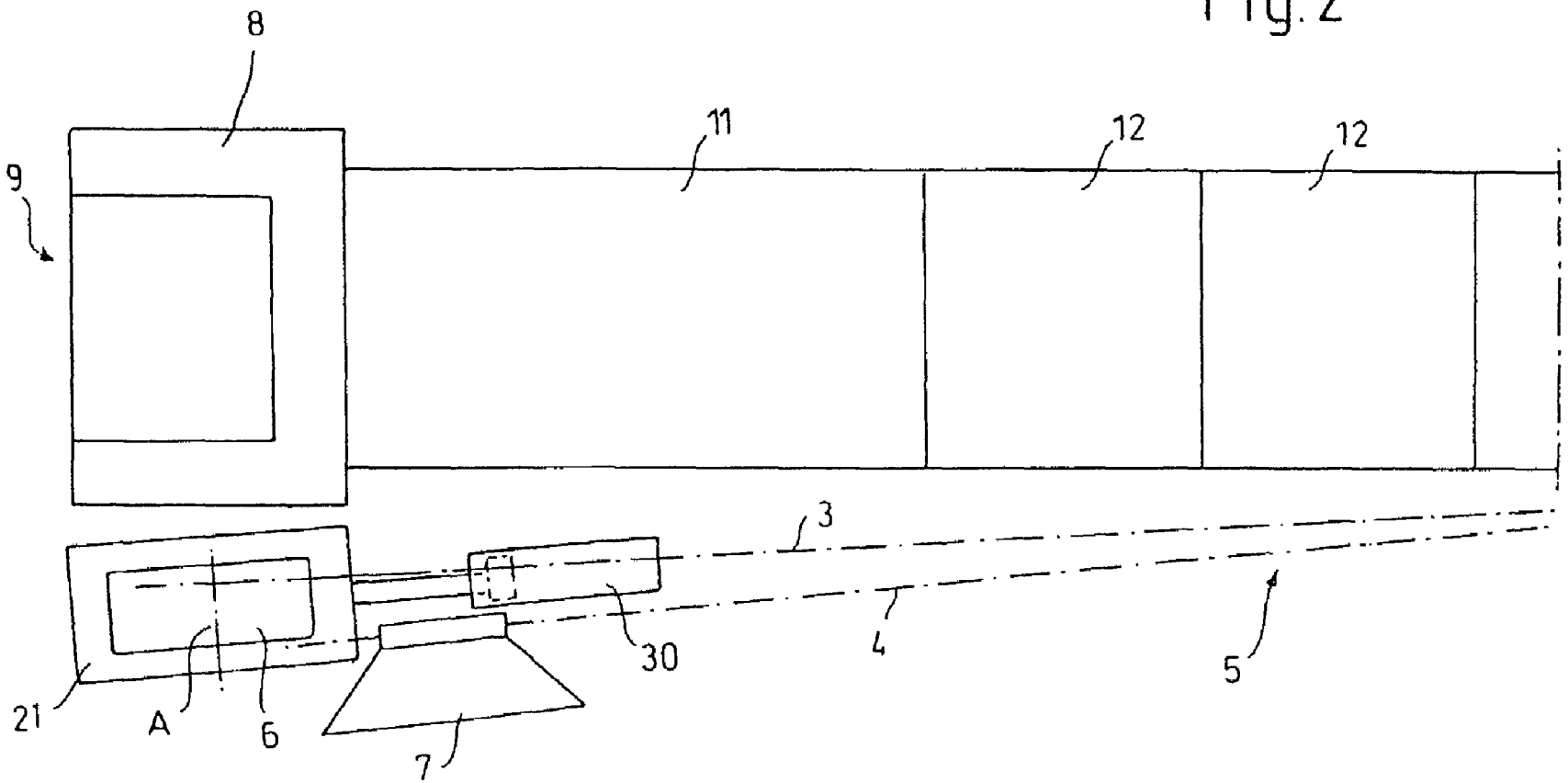
FIG. 2 shows a diagram of the set-up of a reversal station of a planer installation according to the invention.

FIG. 2 shows a diagram of the preferred set-up of a tensionable reversal station 10 of a coal planer installation according to the invention. In FIG. 2, too, the nondriven deflection chain wheel is designated by reference symbol 6, the lower strand of the planer chain 5 by reference symbol 4, the upper strand of the planer chain 5 by reference symbol 3 and the planer body by reference symbol 7. As will also be explained, the deflection chain wheel 6 is mounted in a slide guide which is an integral part of a planer guide built on a machine frame 8 of a chain scraper conveyor 9, merely indicated diagrammatically. FIG. 2 also indicates a connecting groove 11 adjacent to the machine frame 8 receiving the drive chain wheel for the conveyor chain, and also a plurality of wedge grooves 12 of the chain scraper conveyor 9, whereas the individual planer guides for guiding the coal planer 7, which are built on the machine frame 8, the connecting groove 11 and the wedge grooves 12 on the work face side, are not illustrated. FIG. 2 likewise does not illustrate a drive for the chain wheel of the chain scraper conveyor 9, said drive mostly being flanged on the machine frame 8 on the packing side.

Figure 3:
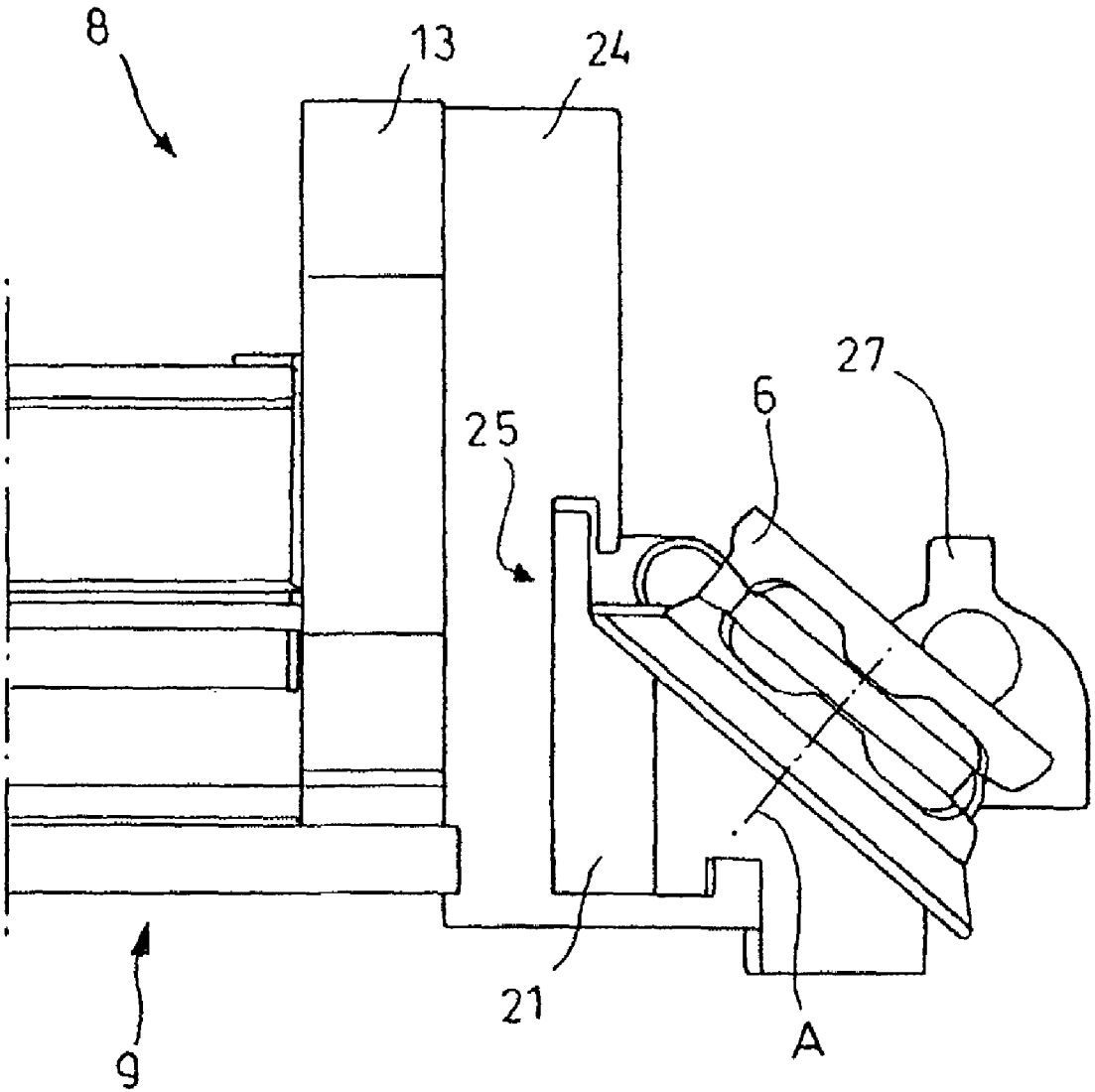
FIG. 3 shows an exemplary embodiment of a deflection station with an obliquely set deflection chain wheel mounted on a slide.
Figure 4:
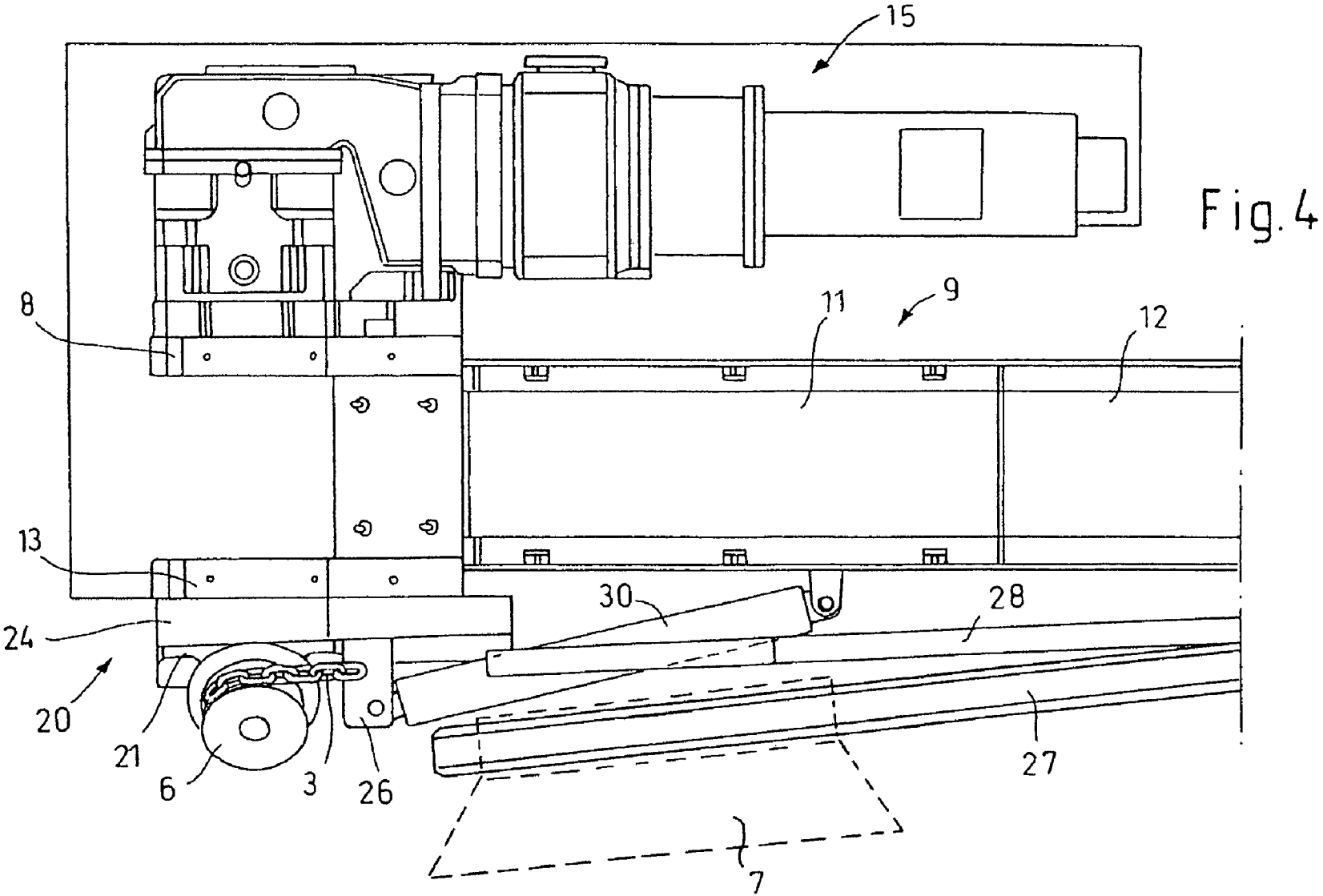
FIG. 4 shows a top view of the reversal station from FIG. 3.

The reversal chain wheel 6 is mounted on a slide 21, indicated merely diagrammatically, in such a way that the axis of rotation A of the deflection chain wheel 6 runs obliquely with respect to the horizontal and therefore the deflection chain wheel 6 lies approximately in a plane which runs at an inclination of between 30° and 60°, preferably of about 45°, between the floor and the coal face, as will also become clear from FIG. 3 and 4. On account of this obliquely set arrangement of the deflection chain wheel 6, the return strand 3 and the tension strand 4 run next to one another, with a height offset and a lateral offset, in the region of the deflection chain wheel 6 or of the reversal station, the lateral distance between the two chain strands 3 and 4 increasing toward the deflection chain wheel 6. At the same time, the planer guides for the coal planer 7 are designed, in the entry region of the deflection chain wheel 6 in such a way that the distance of the planer guides and the distance of the two chain strands 3, 4 from the side cheeks of the connecting and wedge grooves 11, 12 increases toward the deflection chain wheel 6. What is achieved by the increasing distance is that a tension cylinder 30 for displacement of the slide 21 and consequently also of the deflection chain wheel 6 mounted rotatably on the slide 21 can be arranged between the planer guide and the chain scraper conveyor 9.

FIG. 3 and 4 show, then, an exemplary embodiment of the reversal station of a coal planer installation 1 according to the invention. In FIG. 3 and 4, the reversal station is designated by reference symbol 20, and it can easily be seen that the deflection chain wheel 6, which is mounted on the slide 21 rotatably about the obliquely set axis of rotation A, is not assigned any drive. Instead, the drive motor 15 illustrated in FIG. 4 is coupled to the drive chain wheel, not illustrated, for the scraper chain of the conveyor 9, said drive chain wheel being mounted on the machine frame 8 of the chain scraper conveyor 9. For guiding the slide 21, that side cheek 13 of the machine frame 8 which is on the work face side has mounted on it a planer guide 24 with a slide guide 25 for the slide 21, which slide guide is open toward the work face and has the slide 21 engaging behind it at a plurality of locations. The tension cylinder 30 for the displacement of the slide 21 in the slide guide 25 is articulated, at one end, on the side cheek of the connecting groove 11 and, at the other end, on a connecting joint 26 arranged on the slide 21, and the position of the tension cylinder 30 is between a planer guide, formed by planer guide sections 27, for the coal planer 7 and the groove sections of the chain scraper conveyor 9. In the region of the deflection chain wheel, a chain guide 28 for the upper return strand 3 of the planer chain runs above the tension cylinder 30.

Numerous modifications which should come within the scope of protection of the accompanying claims are evident to a person skilled in the art from the above description. The figures illustrate merely diagrammatically the set-up of a coal planer installation according to the invention and of a reversal station for coal planer installation according to the invention. In particular, numerous modifications are possible for the set-up of a slide guide, the arrangement of the tension cylinder, etc. Complex movement algorithms may also be selected for the displacement of the deflection chain wheel, whereby, if appropriate, shortly before the reversal of the coal planer, the chain tension is briefly increased again before it is lowered to the minimum value. The oblique setting of the deflection chain wheel may be varied and may even lie outside the specified range of 30° to 60°.

The invention claimed is:

1. A method for mining using a planer installation, the planer installation including a planer, a planer chain, a drive station having a drive chain wheel and a drive, and a deflection station having a deflection chain wheel, the method comprising:

moving the planer reversibly between the drive station and the deflection station using the planer chain; and displacing the deflection chain wheel based upon at least one of a direction of movement of the planer or a position of the planer.

2. The method of claim 1, wherein a reversing cycle of the planer includes a movement of the planer from the drive station to the deflection station and from the deflection station back to the drive station;

the deflection chain wheel is moved into a position with maximum chain pretension one of before or at a start of the reversing cycle; and the deflection chain wheel is moved into a position with minimum chain tension during the reversing cycle one of continuously or according to a movement algorithm.

3. The method of claim 1, wherein the deflection chain wheel is mounted on a slide, the slide being guided displaceably in a slide guide.

4. The method of claim 1, wherein an axis of rotation of the deflection chain wheel is oriented at an angle of approximately 30° to 60° with respect to the horizontal.

5. A planer installation for mining, comprising:

a movable planer;

a planer chain for moving the planer;

a drive station having a drive and a drive chain wheel for driving the planer chain;

a driveless deflection station;

a deflection chain wheel located in the deflection station;

a slide; and a tension device, wherein the planer is moved between the drive station and the deflection station;

the deflection chain wheel is located on the slide; and the slide is displaced by the tension device, based upon at least one of a direction of movement or a position of the planer 6. The planer installation of claim 5, wherein an axis of rotation of the deflection chain wheel is positioned obliquely.

7. The planer installation of claim 6, wherein the axis of rotation of the deflection chain wheel is oriented at an angle of approximately 30° to 60° with respect to the horizontal.

8. The planer installation of claim 5, further comprising:

a conveyinq device including at least one planer guide element, at least one groove, and a conveyor chain belt;

at least a first conveying drive station and a second conveying drive station; and a slide guide, wherein the at least one planer guide element is operable to guide the planer;

the conveyor chain belt is driven continuously by the first conveying drive station and the second conveying drive station; and the slide is guided within the slide guide.

9. The planer installation of claim 8, further comprising:

at least one tension cylinder located between the planer guide and the a side cheek of the corresponding drive station, wherein the at least one tension cylinder is operable to displace the slide.

10. The planer installation of claim 8, wherein a distance of the planer guide from the at least one grooves of the conveying device increases in an entry region of the deflection chain wheel.

11. The planer installation of claim 9, wherein the tension cylinder is articulated at a first end one of on a side cheek of a machine frame or of the at least one groove; and the tension cylinder is articulated at as second end on the slide.

12. The planer installation of claim 5, wherein the planer chain includes a tension strand and a return strand;

the tension strand and the return strand of the planer chain run next to one another with a height offset in a region of the deflection chain wheel; and the tension strand and the return strand run one above the one another with a height offset on a longwall face and at the drive chain wheel.

* * * * *